United States Patent [19]

Booth

[11] 3,978,627

[45] Sept. 7, 1976

[54] BURIAL FACILITY

[76] Inventor: Clyde C. Booth, 6001 Northwest Highway, Suite 400, Oklahoma City, Okla. 73132

[22] Filed: May 12, 1975

[21] Appl. No.: 576,587

[52] U.S. Cl. ..... 52/136; 52/134; 52/234; 52/169 R; 52/169 DT

[51] Int. Cl.[2] ..... E04H 13/00

[58] Field of Search ..... 52/128–137, 52/169, 234, 236

[56] References Cited

UNITED STATES PATENTS

| | | | |
|---|---|---|---|
| 912,368 | 2/1909 | Downey | 52/136 |
| 980,750 | 1/1911 | Blyth | 52/136 |
| 1,110,520 | 9/1914 | Woodard | 52/131 |
| 1,288,254 | 12/1918 | Stanley | 52/136 |
| 1,858,722 | 5/1932 | Walker | 52/134 |
| 3,596,419 | 8/1971 | Jalbert | 52/169 |

*Primary Examiner*—J. Karl Bell
*Attorney, Agent, or Firm*—William R. Laney

[57] ABSTRACT

A burial facility comprising a rigid burial housing enclosing multiple burial crypts, burial services compartmentation, walk ways and facility maintenance spaces, said housing having a major portion thereof below ground level and a portion thereof above ground level, a frusto-pyramidal earthen mound covering and concealing the portion of said housing above ground level, and a downwardly sloping entryway extending through one side of said frusto-pyramidal earthen mound and communicating through an opening in one side of said housing with the interior thereof.

8 Claims, 11 Drawing Figures

BURIAL FACILITY

BACKGROUND OF THE INVENTION

1. Field of the Invention

This invention relates to stationary, people-accommodating structures, and more particularly, to a unique and aesthetic burial facility which includes a rigid burial housing in which the remains of deceased persons may be interred, and in which those activities of the living which involve association with the dead, such as the conducting of funeral services and visitation of the last resting place, can be carried out.

2. Brief Description of the Prior Art

Today there exist two basic types of burial facilities utilized as a repository for the remains of those who have departed this life. In the more traditional cemeteries, the remains of the deceased are usually deposited in a casket or container and placed in the earth below ground level. In the other type of widely used burial facility, a mausoleum structure which provides above-ground crypts for the entombment of earthly remains is utilized as the last resting place often selected for interment. Perhaps one of the most obvious disadvantages of cemetery earth-type burial facilities is the very considerable area which is required to accommodate relatively few interments. In the most conventional and widely used type of cemetery facility, a single interment will require approximately 40 square feet of land surface area. Another undesirable aspect of below-ground type burials in outdoor grave sites is that it is frequently uncomfortable or even impossible to visit the gravesite to pay respects to the departed due to inclement weather. Moreover, in many instances, the alleged perpetual care accorded by maintenance personnel and the managing facility is of relatively short duration, and the burial plots or cemeteries become overgrown or unkempt in a relatively few years. Finally, for those individuals who experience a deep concern for the protection and preservation of the earthly remains of a deceased loved one, the earth-type burial does not, considering the average construction of the modern casket, afford significant protection to the remains from the elements, and from normal temperature changes of substantial magnitude occuring from season to season.

Interment in crypts of the type provided in most presently available above-ground mausoleums does, of course, afford the advantage of providing a temporary protective site for the last resting place of the deceased where those who wish to pay their respects may come and do so in inclement weather. The construction of many mausoleum burial facilities, however, has not made adequate or satisfactory provision for the preservation of the remains of the deceased and, though such occasions may rarely occur, the necessity or desirability of disinterment for purposes of effecting transfer of the remains of the deceased to another resting place has often been a very shocking experience. In some mausoleum constructions, adequate assurance against the infiltration of seepage of moisture and water into the burial crypts has not been provided, nor has adequate drainage from the structure been included to prevent, not merely an unsightly and distasteful setting for visitation, but so as to prevent an actual health hazard to the surrounding community. Further, the circulation of air through the crypts results in accelerated deterioration and decomposition of the bodies there interred.

Neither of the types of burial facilities described usually provides any sort of integrated interment facilities with accommodations for conducting final services honoring the deceased immediately prior to interment. With cemeteries, there may be chapels provided on the situs of the cemetery, but it is still frequently necessary to walk or drive some distance to reach the gravesite. Most mausoleum structures, on the other hand, are not of sufficient size and do not provide the decor appropriate to the conducting of last services within the mausoleum structure.

BRIEF DESCRIPTION OF THE PRESENT INVENTION

The present invention comprises a burial facility incorporating novel and unique concepts of final interment which overcome substantially all of the objectionable aspects which characterize the types of interment facilities prevalently in use at this time. Broadly described, the burial facility of the present invention comprises an aesthetic, combined natural and artificial structure in which minimum space utilization is required for the entombment of many deceased persons, in which facilities are located in close proximity to aesthetic crypts for the purpose of permitting final services to be conducted with minimum inconvenience and maximum comfort to the participants, and in which the overall structure aesthetically blends into the natural surroundings, and is an attractive addition to either an urban or rural environment.

The burial facility of the invention comprises a rigid burial housing or structure which encloses multiple, tiered burial crypts of varying sizes, burial services compartmentation for providing a tasteful and suitable environment for the conducting of funeral services, and paying of last respects to a deceased immediately prior to interment in a selected crypt located in close proximity to such burial services compartmentation, walk ways within the burial housing facilitating visitation to the situs of the last remains of a loved one in any type of weather, and at any hour of the day or night, and strategically and inconspicuously located facility maintenance spaces for storing maintenance equipment and supplies, and for housing the utility service structures utilized in the burial facility. The burial housing is, in a preferred embodiment of the invention, a generally rectangular parallelepiped type concrete or masonry structure which has a lower portion disposed below ground level, and an upper portion projecting above ground level. The upper portion of the rigid burial housing is aesthetically covered and concealed by a frusto-pyramidally shaped, turf-covered mound of earth. An aesthetically constructed, downwardly sloping entryway extends through one side of the frusto-pyramidally shaped earthen mound, and communicates through an opening in one side of the burial housing with the interior of the housing.

The thus broadly described burial facility of the invention provides a number of advantages with respect to more conventional, currently used interment systems, and enables a number of important objectives of the invention to be realized. Among these objectives is the provision of an aesthetic burial facility which is capable of accommodating the earthly remains of a great number of deceased persons in a relatively small space, and in preserving these remains in a sanitary and composed condition over an extended period of time.

A further object of the invention is to provide a burial facility which provides tiered, hermetically sealed crypts.

Another object of the invention is to provide a burial facility in which comfortable, private accommodations are made available for conducting funeral services.

An additional object of the invention is to provide a burial facility which can be used for the sanitary and aesthetic interment of the dead at lesser cost and expense to the survivors than currently available burial facilities.

Additional objects and advantages of the invention will become apparent as the following detailed description of a preferred embodiment of the invention is read in conjunction with the accompanying drawings which illustrate such preferred embodiment.

BRIEF DESCRIPTION OF THE DRAWINGS OF THE APPLICATION

DETAILED DESCRIPTION OF A PREFERRED EMBODIMENT OF THE INVENTION

Figure 1:
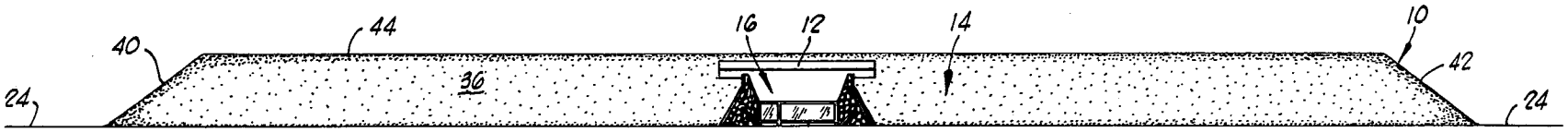
FIG. 1 is a front elevation view of the burial facility of the invention.
Figure 2:
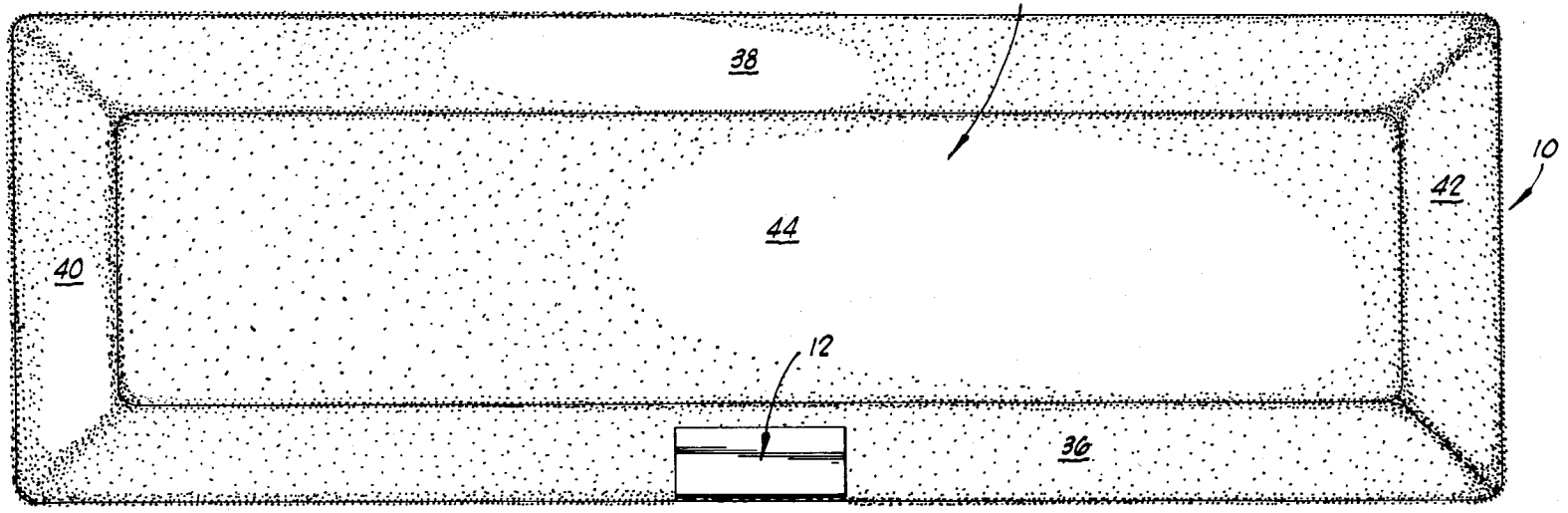
FIG. 2 is a plan view of the burial facility of the invention.
Figure 3:
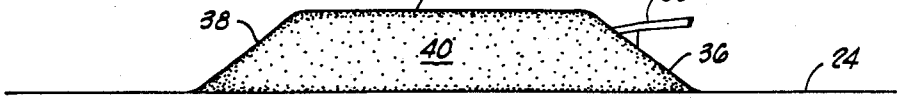
FIG. 3 is an end elevation view of the burial facility of the invention.

The burial facility of the invention is referred to generally in the drawings by reference numeral 10. The facility may be described as broadly including two basic components or structures. These include a burial housing 12 (see FIGS. 4 and 5), and a frusto-pyramidal earthen mound 14 which covers and conceals the housing. An entryway designated generally by reference numeral 16 is provided at one side of the burial facility and extends through one side of the frusto-pyramidal earthen mound and communicates, in a manner hereinafter explained in greater detail, through an opening at one side of the housing 12 with the interior thereof.

Referring initially to certain major structural aspects of the housing 12, in the embodiment of the invention here illustrated and discussed for illustrative purposes, the housing is of generally rectangular parallelepiped configuration having generally parallel side walls which include a front or forward wall 20 and a rear wall 22, both of which walls extend vertically from a position below ground level (ground level is here designated generally by reference numeral 24 as shown in the drawings) to a position above ground level. The housing also includes a pair of end walls 26 and 28 disposed at opposite ends thereof, a floor 30 and a roof or ceiling 32. The interior of the housing 12 is hollow or open for the interior location of certain interment facilities, and for accommodations for the conducting of funeral services and other activities as will be hereinafter explained.

In a preferred embodiment of the invention, the side walls 20 and 22 of the housing 12 are about 14½ feet in height with 7½ feet of each of the walls disposed below ground level, and about 7 feet projecting above ground level. Immediately surrounding the side walls 20 and 22, the end walls 26 and 28 and the roof 32 of the housing 12 and positioned between these walls and the surrounding earth is a layer 33 of gravel or other relatively coarse aggregate material having a thickness, as measured transversely through the bed of gravel or aggregate, of about 12 inches.

The frusto-pyramidal earthen mound which covers and conceals the housing 12 extends upwardly to a height of about 12½ feet above ground level so that about 4 or 5 feet of earth is located between the top of the housing 12 and the top of the frusto-pyramidal mound. The mound 14 characteristically has a sloping front or forward face 36, a sloping back or rear face 38, sloping or inclined end faces 40 and 42 and a top or plateau 44 disposed at the upper side thereof. The plateau of the mound 14 is preferably slightly sloped or inclined from its line of intersection with the forward face 36 to its line of intersection with the rear face 38 to facilitate drainage. The transverse width and length of the plateau are such that the area defined within the base of the mound 14 at ground level is about thirty feet longer and thirty feet wider than these dimensions of the plateau 44. In other words, the bottom of the mound 14 projects at all points therearound 15 feet beyond the projected boundary of its plateau or top 44.

The entryway 16 through the side of the mound 14 into the housing 12 includes a cantilevered canopy 50 which constitutes an extension of an internal ceiling 52 which is supported between textured stone side walls 54 and 56 disposed on opposite sides of an open passage which projects downwardly through the front wall 20 of the housing. A flagstone approach 58 disposed at ground level leads to stairs 60 which extend downwardly through the opening formed in the front wall 20 and are disposed between the side walls 54 and 56. Spaced appropriately above the stairs 60 are a pair of handrails 62 secured to the walls 54 and 56. The stairs 60 terminate at their lower end at a vestibule or lobby 64 which confronts a pair of cooperating brass doors 66 which open into the interior of the housing 12. The vestibule or lobby 64 is at the same level as the floor 30 of the housing 12.

The interior of the housing 12 is partitioned into a plurality of rooms, and into burial crypts, as will be more specifically hereinafter described. Extending the length of the housing 12 between the end walls 26 and 28 is an elongated central concourse 70. The concourse 70 is directly accessible from the lobby 64 through the doors 66. Immediately adjacent the interior of the entryway 16 is a viewing room 72. The viewing room 72 is provided with glass paneling 73 at the forward side thereof adjacent the concourse or corridor 70, and functions to enable the immediate family of the deceased to be seated in a private location, and to view the casket carrying the last remains, and the services being conducted at a location indicated by the letter S. The wall of the viewing room 72 which is adjacent the crypts 84 is provided with a transparent panel 74 which is covered by a curtain which can be drawn to enable interested persons to view the interior of a typical crypt and the manner in which such crypt is finished.

Immediately adjacent the location S, an arcuate countersunk track 76 is provided to permit a curtain or movable collapsible partition (not shown) to be used to close off a space 78, or to open up this space, as may be desired. A portable or movable pulpit or podium 80 is provided to permit a minister to conduct services at the indicated location. A compartment or room 82 is provided at a relatively central location in the housing 12 for the accommodation of maintenance equipment and storage of the paraphernalia used for ordinary or special last rites and services, and for the performance of the other functions and activities carried on in the burial facility regularly, as well as more infrequently and intermittently.

Figure 4:
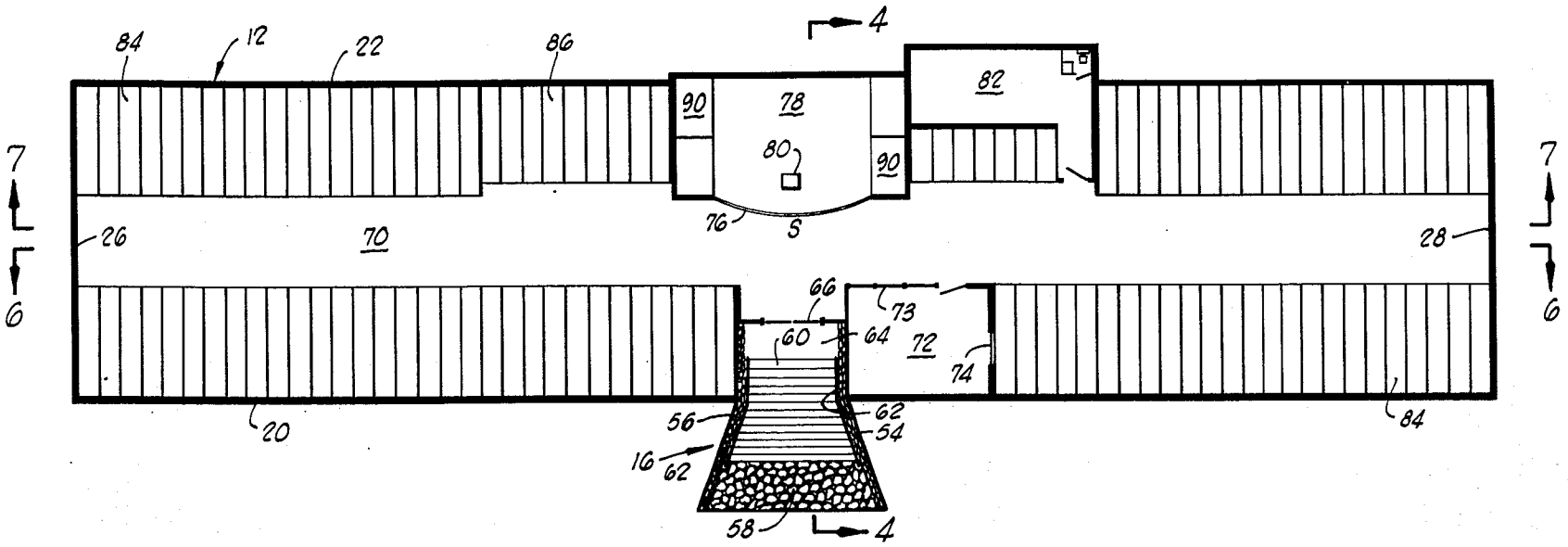
FIG. 4 is a sectional view taken along line 4—4 of FIG. 5.
Figure 5:
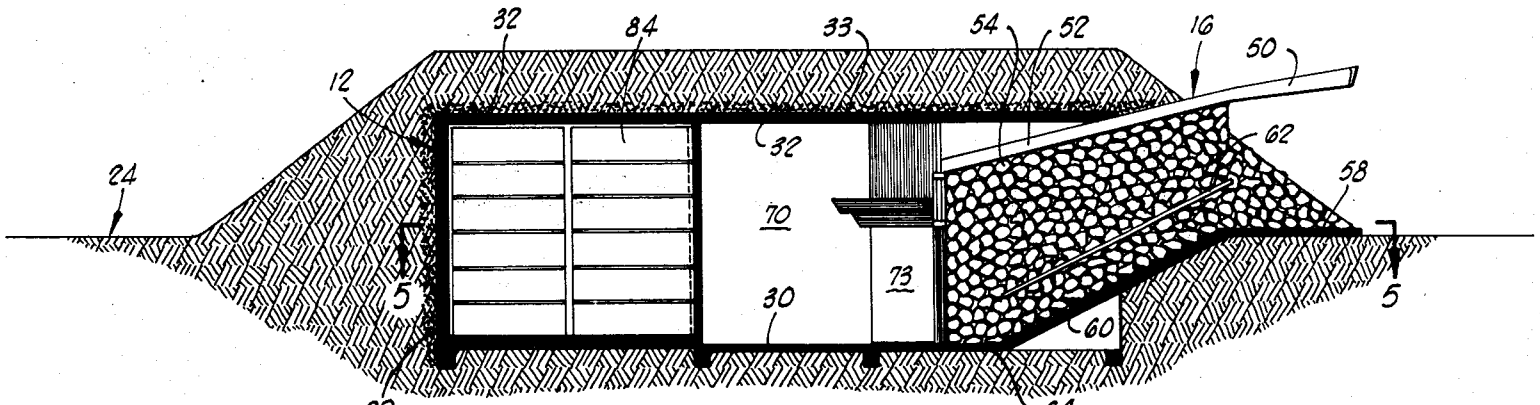
FIG. 5 is a sectional view taken along line 5—5 of FIG. 4.
Figure 6:
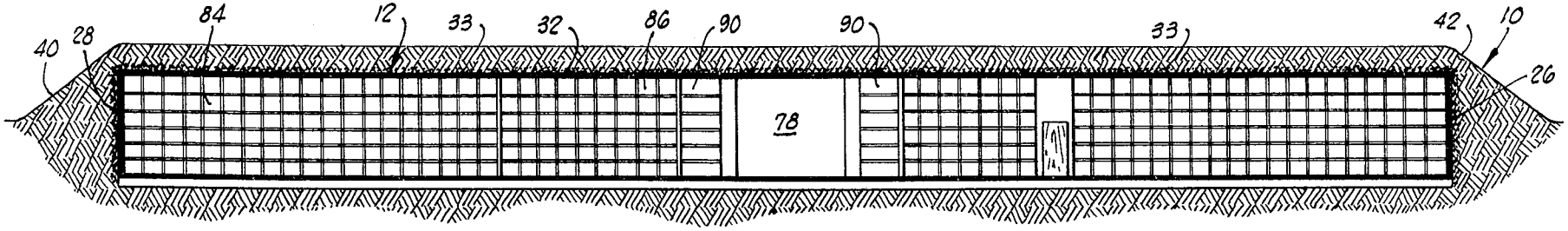
FIG. 6 is a sectional view taken along line 6—6 of FIG. 5.
Figure 7:
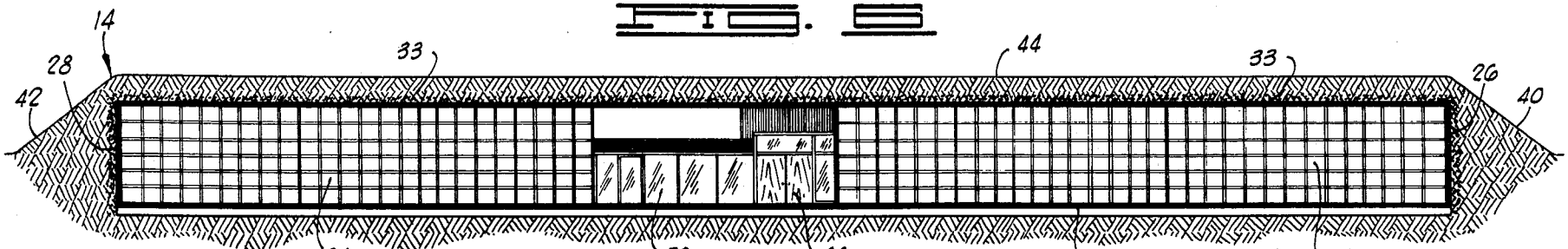
FIG. 7 is a sectional view taken along line 7—7 of FIG. 5.

The construction of the crypts within the housing 12 is according to a predetermined plan which facilitates activity by patrons, and accords maximum accommodation for the space available. The greater number of crypts are dimensioned for the accommodation of the usual earthly remains of two deceased adults. A typical one of these crypts is shown in FIG. 4 of the drawings, and is identified by reference numeral 84. The adult crypts are vertically tiered, with six tiers or levels provided between the ceiling 32 and the floor 30.

As will be perceived in referring to FIG. 4, at each crypt level, two of the crypts are aligned in end-to-end relation, so that two caskets can be accommodated on each level. A series of crypts 86 are also provided for accommodating infants. These crypts are, of course, of a smaller size, but are vertically tiered in general similarity to the adult crypts.

Flanking the space 78 are four double crypts 90. The double crypts 90 are each sufficiently wide to accommodate two caskets in side by side relation, and thus can facilitate interment of those who may desire to thus be laid to rest side by side.

The manner in which the crypts of the burial facility are constructed is best illustrated in FIGS. 8–11. When constructing the crypts, there are initially formed a plurality of vertical concrete walls 100 which are reinforced by the extension of suitable metal rods 102 vertically therein. The walls 100 are formed with horizontally extending trapezoidally cross-sectioned sockets or indentations 104 formed at vertically spaced locations therein for the interlocking accommodation of a plurality of horizontal walls 106 in the manner hereinafter described. Each of the vertical walls 100 has formed therethrough between pairs of horizontally aligned sockets or indentations 104, a plurality of passageways 108 for the accommodation of reinforcing rods used for reinforcing and supporting the horizontal walls 106, also as hereinafter explained.

Figure 9:
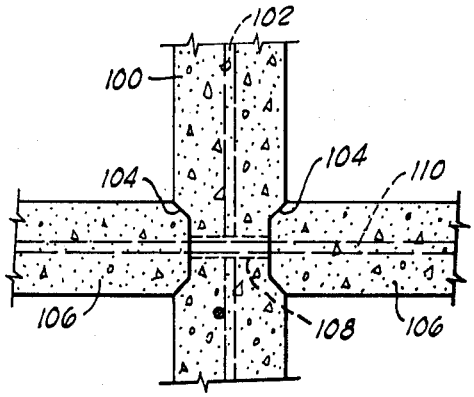
FIG. 9 is a structure detail illustrating further the manner in which the crypts used in the burial facility are constructed.
Figure 10:
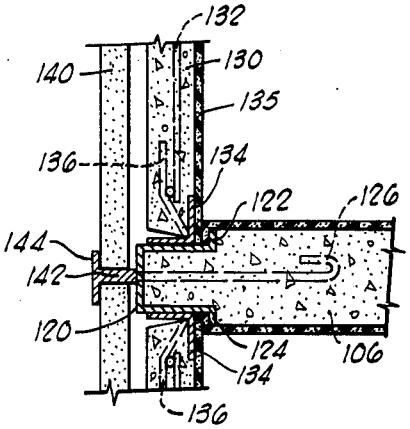
FIG. 10 is a sectional view taken along line 10—10 of FIG. 11.

The horizontal walls 106 which define the upper and lower boundaries of each crypt are illustrated fragmentally in FIGS. 9 and 10. Each horizontal wall 106 constitutes a slab having side edges of trapezoidal cross-section along the opposite sides thereof, with these side edges being configured and dimensioned to register with the indentations 104 formed in the vertical walls 100. The horizontal walls 106 are cast in place using suitable forms, and in the course of such casting, are cast around horizontally extending bars or rods 110 which are several crypts in length, and which are made to bridge across the vertical walls by extension through the passageways 108 formed through the respective vertical walls 100 between the trapezoidally shaped indentations or sockets 104. The described construction assures a strong structural connection between the vertical walls 100 and the horizontal walls 106, and imparts very high mechanical strength to the crypt construction. Each of the crypts opens at the front or forward side which faces upon the concourse 70 (as initially constructed by the erection of the vertical walls 100 and horizontal walls 106), and the crypts are closed at the opposite ends by intersection of the walls 100 and 106 with the vertical forward and rear walls, 20 and 22, of the housing 12. It is through the opening at the forward side of each of the crypts that the casket bearing the last remains of the deceased is placed in the course of interment.

Figure 8:
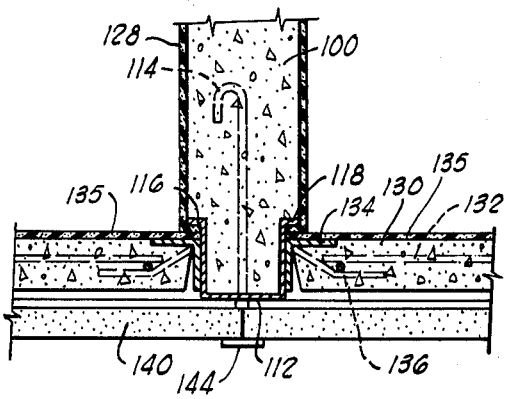
FIG. 8 is a structural detail view illustrating the manner in which the crypt side walls and forward closure members are constructed and interconnected.
Figure 11:
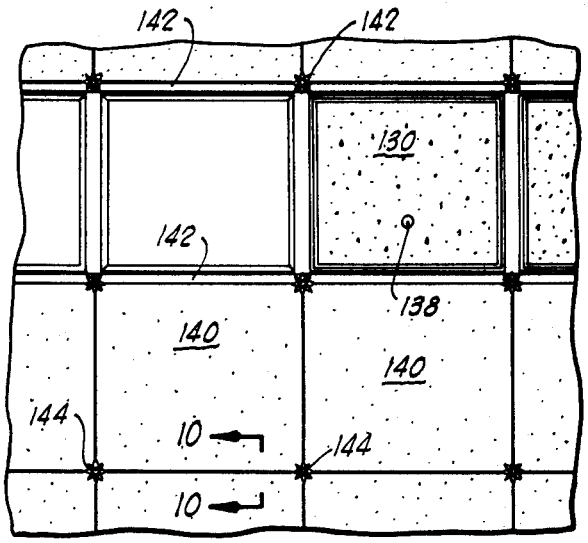
FIG. 11 is a front elevation view of several of the crypts illustrating one of the crypts open, one of the crypts with the closure plate in place, and several of the crypts with the finishing plates in position.

The structure employed for closing and sealing the crypts is illustrated in FIGS. 8, 10 and 11 of the drawings. Along each forward, vertically extending edge of each of the vertical walls 100, a U-shaped steel facing plate 112 is used to cap and face this forward edge of the vertical wall by securement to the wall using hook-shaped anchoring members 114 which are embedded in the concrete of the wall. It will be noted that each of the U-shaped facing plates 112 is provided with a pair of toe portions 116 and 118 which face outwardly toward the concourse 70.

In similar fashion, a steel capping or facing plate 120 is secured over the exposed forward edge of each horizontal wall 106 which faces the concourse 70, and presents an exposed front side in facing relation to the concourse. The facing plate 120 is also provided with outwardly extending toe portions 112 and 124 similar to the toes provided on the facing plate 112 used on each of the vertical walls 100. Hook-shaped anchoring members 126 are used for securement of the facing plate 120 to the respective horizontal wall 106. The interior surfaces of the vertical walls 100 and horizontal walls 106 which define each of the crypts is sprayed with an air impermeable elastomeric coating 128 which is preferably polyurethane. The coating 128 is further extended to provide a resilient coating or layer covering the toe portions 116 and 118, 122 and 124 of the facing plates 112 and 120.

For the purpose of sealing and hermetically closing each of the crypts, a sealing block or slab designated generally by reference numeral 130 is provided. Each sealing block 130 is constructed of concrete and has a plurality of steel rod reinforcing members 132 embedded therein. Secured around the four side edges of the sealing blocks are a plurality of steel weld angles 134. These weld angles 134, which are fitted into accommodating recesses in the respective block 130 so as to provide a flange lying flush with the inner or back side of each block, are secured to the respective block by means of suitable bent rods 136 extending into and embedded in the respective blocks. Although the number of the weld angles 134 provided along the side edges of each block may vary, I prefer to provide two of these along each side edge of each block. An elastomeric coating 135 is provided on the inner surface of each of the blocks 130.

In implacing each sealing block in its crypt-closing and sealing position, the block is fitted in place so that the weld angles 134 mate with the flanges of the facing plates 112 and 120, as shown in FIGS. 8 and 10. It will be noted that at this time, the coated surface of the respective sealing block bears against the respective toe flanges 116, 118, 122 or 124 of the respective facing plates, and thus sealingly engages the elastomeric coating 128. An air-tight seal is thus formed completely around the line of contact of the respective sealing block 130 with the side walls 100 and horizontal walls 106. The sealing block 130 is then secured in position by welding the exposed outer end portions of the weld angles 134 carried thereon to the steel facing members 112 and 120 with which these weld angles are in contact.

As shown in FIG. 11, each of the sealing blocks 130 is provided with a small, self-sealing aperture or passageway 138 provided through a relatively central portion thereof. A nozzle carried on the end of a tube or conduit connected to an evacuating device (not shown) can be inserted in this aperture or passageway for the purpose of withdrawing the air from the interior of the crypt, and creating a relatively high vacuum inside the crypt. Following interment and placement of the sealing block 130 in position, the evacuation of the crypt is carried out in the manner described, and, upon withdrawal of the nozzle of the evacuating apparatus, the self-sealing function of the aperture 138 occurs to seal the crypt, and to provide a relatively inert, air-free atmosphere inside the crypt.

For the purpose of finally completing the interment, and the closure of each crypt, and particularly in order to provide an aesthetic appearance to the interior of the burial facility of the invention, a marble facing slab 140 is positioned over each crypt (both before and after interment). To retain the marble facing slabs 140, each of the vertically extending facing plates 112 has welded thereto adjacent each corner of each crypt, a pin 142 which projects outwardly therefrom and carries at its outer end a retainer rosette 144 which is threadedly engaged with the outer end of the pin. The rosettes 144 can be removed as necessary to permit removal of a selected facing slab 140, and then later replaced following interment. This enables each of the marble facing slabs 140 to be easily positioned in or removed from, a position of retention between the several retainer rosettes 144.

From the foregoing description and by reference to the figures of the drawings it will be perceived that the burial facility of the invention presents a unique approach to, and concept of, interment of the earthly remains of deceased persons. The burial facility combines certain advantages of above-ground, mausoleum type interment with those desirable characteristics which are to be attained in subterranean cemetery type interment. More importantly, however, those objectionable aspects and features of each of these two widely used types of interment as previously employed have been eliminated in the burial facility of this invention.

The facility can accommodate and provide entombment facilities for a great number of persons in a relatively small space. Very importantly, the facility is much more aesthetic than most mausoleum structures, providing an appearance of naturalness and further providing the permanency of underground interment which is combined with the dignity of individual crypts. The crypt entombment locations are easily accessible at all times and in all types of weather to the survivors of the deceased person, and the burial facility enables funeral services to be conducted in a quiet atmosphere with dignity and privacy. Further, such services are in the immediate proximity of the location of entombment, thus making it very easy for persons of advanced age, and some physical disabilities or incapacities, to attend such services and the interment without engaging in long walks or a drive of many miles from church or chapel facilities to the location of the final interment.

The burial facility is entirely self-contained and includes within the structure, all the equipment necessary for effective maintenance of the facility. The construction of the burial housing 12 with the stone or aggregate disposed in a layer of some 6 to 18 inches around the concrete walls of the housing assures the relief of stresses resulting from changing pressures and forces exerted by the surrounding earth with the changing temperature as the seasons change, and protection from the effect of harsh chemicals in the earth.

The crypt chambers provided in the burial facility are unique in several respects. Several types of crypts are provided, according to the particular desires or needs of the family of the deceased, and all of the crypts can be hermetically sealed and evacuated to afford maximum preservation of the remains over extended periods of time. The sealing of the crypts can be quickly and effectively accomplished, and the marble facing slabs which are placed over the sealed crypts afford an aesthetic, finished appearance to the interior structure of the burial facility. The mechanical strength of each crypt is very high due to the manner in which the crypts are constructed with interlocking and interfitting wall slabs or panels.

Although a preferred embodiment of the invention has been herein described, it will be understood that various changes and innovations in the illustrated and described structure can be effected and brought about without change in the basic principles which underlie the invention, or departure therefrom. Changes and innovations of this type are therefore deemed to be circumscribed by the spirit and scope of the invention, except as the same may be limited by the appended claims or reasonable equivalents thereof.

What is claimed is:

1. A burial facility comprising:

a rigid burial housing of generally right parallelepiped configuration having a portion disposed below ground level and a portion projecting above ground level;

walls and partitions within said housing defining:

a plurality of tiers of interment crypts;

a concourse extending between said tiers of crypts;

a plurality of rooms including a viewing room positioned adjacent said concourse and having glass paneling along one side thereof facing said concourse to enable persons in said viewing room to view the area within said burial housing across said concourse from said viewing room; and funeral services facilities including a space defined by said walls and partitions across said concourse from said viewing room to facilitate viewing by persons in said viewing room of funeral services conducted at the locus of said funeral services facilities;

a generally frusto-pyramidal earthen mound covering and concealing that portion of said housing which projects above ground level and including four sloping earthen walls inclined with respect to the vertical; and a downwardly sloping entryway extending through one side of said frusto-pyramidal earthen mound and communicating through an opening in one side of said housing with the interior thereof, said entryway communicating through the opening in said one side of said housing directly with said concourse at a location immediately adjacent said viewing room and in direct alignment with said funeral facilities on the opposite side of said concourse therefrom; and a layer of particulate aggregate material positioned between the outer side of the walls and roof of said housing and the earth of said frusto-pyramidal earthen mound.

2. A burial facility as defined in claim 1 and further characterized as including a transparent panel at one side of said viewing room and in one side of at least one of said crypts to facilitate viewing of the interior of one of said crypts by persons in said viewing room.

3. A burial facility as defined in claim 1 wherein each of said crypts comprises:

a plurality of horizontally spaced, vertical walls each having elongated sockets therein with the sockets in said vertical walls being horizontally aligned;

a plurality of vertically spaced, horizontal walls extending between said vertical walls and each having side edges complementary in configuration to said sockets and registering with said sockets in two adjacent vertical walls;

said vertically extending and horizontally extending walls defining a chamber open at a side thereof facing said concourse, said opening being defined by aligned side edges of each of said vertically extending walls and said horizontally extending walls;

metal facing plates secured cver each of said aligned side edges of said vertically extending walls and said horizontally extending walls;

a sealing block positioned in said opening;

an elastomeric material sealingly positioned between said sealing block and said vertical walls and horizontal walls;

means securing said facing plates to said sealing block; and a self-sealing passageway extending through said sealing blocks from a surface thereof facing toward said concourse and outside said crypt to an interior surface thereof facing inwardly in said crypt, said self-sealing passageway facilitating evacuation of the air from said crypt when said crypt is closed by said sealing block and is sealed thereby.

4. A burial facility as defined in claim 3 as further characterized as including a coating of an elastomeric material covering the interior surfaces of said vertically extending walls and said horizontally extending walls which define each of said crypts, and covering the interior surface of said sealing block.

5. A burial crypt structure comprising:

a pair of vertically extending, substantially parallel walls, said walls each having a pair of parallel, vertically spaced sockets therein with two aligned pairs of sockets in the two opposed vertically extending walls, and further having a plurality of passageways projecting through each wall and intersecting and communicating with said sockets;

horizontally extending bars extending between the aligned sockets in each of said pair of aligned sockets and projecting into the passageways which communicate with the respective sockets;

a pair of horizontally extending, substantially parallel walls having said bars embedded therein, said horizontally extending walls each having opposed side edges extending into and mating with the sockets in said vertically extending walls, said vertically extending and horizontally extending walls defining a chamber open at one side thereof at a location where edges of said vertically extending and horizontally extending walls are aligned in a common plane;

means closing the side of the chamber directly opposite the open side thereof;

metal facing plates secured over each of said aligned edges of said walls adjacent said opening at one side of said chamber;

a sealing block positioned in and sealing the open side of said chamber;

an elastomeric material sealingly positioned between said sealing block and said vertically extending and horizontally extending walls;

means securing said facing plates to said sealing blocks; and a self-sealing passageway extending through said sealing blocks from a surface thereof facing toward said concourse and outside said crypt to an interior surface thereof facing inwardly in said crypt, said self-sealing passageway facilitating evacuation of the air from said crypt when said crypt is closed by said sealing block and is sealed thereby.

6. A burial crypt as defined in claim 5 and further characterized as including a coating of an elastomeric material covering the interior surface of said vertically extending walls and said horizontally extending walls which define each of said crypts, and covering the interior surface of said sealing block.

7. A burial crypt as defined in claim 6 and further characterized as including a facing slab removably positioned over, and extending parallel to, said sealing block.

8. A burial crypt as defined in claim 6 wherein said means securing said facing plates to said sealing block comprises weld angles secured to said sealing block and welded to said facing plates.

* * * * *